US008950210B2

(12) United States Patent
Junge

(10) Patent No.: US 8,950,210 B2
(45) Date of Patent: Feb. 10, 2015

(54) TOP MOUNT REFRIGERATOR AIRFLOW SYSTEM

(75) Inventor: Brent Alden Junge, Evansville, IN (US)

(73) Assignee: General Electric Company, Schenectady, NY (US)

( * ) Notice: Subject to any disclaimer, the term of this patent is extended or adjusted under 35 U.S.C. 154(b) by 167 days.

(21) Appl. No.: 13/545,103

(22) Filed: Jul. 10, 2012

(65) Prior Publication Data

US 2014/0013793 A1 Jan. 16, 2014

(51) Int. Cl.
*F25D 17/06* (2006.01)
*F25D 11/02* (2006.01)

(52) U.S. Cl.
USPC ..... 62/419; 62/426; 62/441

(58) Field of Classification Search
CPC ..... F25D 17/045; F25D 17/06; F25D 11/02; F25D 17/065; F24F 5/0017
USPC ..... 62/419, 426, 441
See application file for complete search history.

(56) References Cited

U.S. PATENT DOCUMENTS 3,872,683 A 3/1975 Blanton
5,156,015 A * 10/1992 Chung ..... 62/187
5,282,367 A 2/1994 Moore et al.
7,926,298 B2 4/2011 Kuehl et al.
2010/0099464 A1 4/2010 Kim
2010/0126201 A1 5/2010 Seo et al.
2011/0011106 A1 1/2011 Ahn et al.

FOREIGN PATENT DOCUMENTS

WO 2010/099464 A2 9/2010

* cited by examiner

*Primary Examiner* — Allen Flanigan
*Assistant Examiner* — Filip Zec
(74) *Attorney, Agent, or Firm* — Global Patent Operations; Douglas D. Zhang

(57) ABSTRACT

A refrigeration system includes an airflow system which eliminates the traditional air tower in the freezer area by utilizing at least one air outlet formed between a freezer cavity area and a fresh food cavity area. The air outlet is configured to permit at least a portion of a cooled air stream generated by a fan of an evaporator assembly and circulated in the freezer cavity area to flow into the fresh food cavity area through the air outlet. The refrigeration system also includes at least one air return formed between the evaporator assembly and the fresh food cavity area. The air return is configured such that air from the fresh food cavity area flows into the evaporator assembly through the air return.

14 Claims, 3 Drawing Sheets

TOP MOUNT REFRIGERATOR AIRFLOW SYSTEM

BACKGROUND OF THE INVENTION

The subject matter disclosed herein relates to refrigerator appliances, and more particularly to increasing energy efficiency and reducing manufacturing costs in such refrigerator appliances.

One common configuration of a refrigerator appliance is known as a top mount configuration. In a top mount configuration, the freezer compartment is located above the fresh food compartment.

A traditional airflow system in such top mount refrigerators utilizes an air tower mounted towards the rear of the freezer compartment. In the air tower-based airflow system, air is drawn over an evaporator coil by an evaporator fan and thereby cooled. Note that the evaporator is the part of the refrigeration system through which refrigerant passes to absorb and remove the heat in the compartments being cooled (e.g., freezer compartment and fresh food compartment). This cooled air is then pushed into the air tower by the evaporator fan. An upper diffuser section of the air tower diffuses a portion of the cooled air it receives from the fan into the freezer compartment. A lower duct section of the air tower directs another portion of the cooled air it receives from the fan into the fresh food compartment.

Such traditional air tower-based airflow systems are designed with a large amount of restriction, specifically in the lower duct portion of the air tower, to insure that the correct proportion of airflow is provided to the fresh food and freezer compartments. However, this large amount of restriction causes the airflow system to work harder, thus reducing the efficiency of the refrigerator.

BRIEF DESCRIPTION OF THE INVENTION

As described herein, the exemplary embodiments of the present invention overcome one or more disadvantages known in the art.

One embodiment relates to a refrigeration system. The refrigeration system comprises a first cooling compartment having a first cooling cavity area and a second cooling compartment having a second cooling cavity area. The first cooling compartment is positioned above the second cooling compartment, and the first cooling cavity area is maintained at a lower temperature than the second cooling cavity area. The refrigeration system also comprises an evaporator assembly comprising an evaporator and a fan. The evaporator assembly is operatively positioned in the first cooling compartment and configured such that a cooled air stream generated by the fan is provided into the first cooling cavity area and circulated therein. The refrigeration system further comprises at least one air outlet formed between the first cooling cavity area and the second cooling cavity area. The air outlet is configured to permit at least a portion of the cooled air stream generated by the fan of the evaporator assembly and circulated in the first cooling cavity area to flow into the second cooling cavity area through the air outlet. The refrigeration system still further comprises at least one air return formed between the evaporator assembly and the second cooling cavity area. The air return is configured such that air from the second cooling cavity area flows into the evaporator assembly through the air return.

In another embodiment, a top mount refrigerator appliance comprises a freezer compartment having a freezer cavity area and a fresh food compartment having a fresh food cavity area.

The appliance also comprises an evaporator assembly comprising an evaporator and a fan, the evaporator assembly operatively positioned in the freezer compartment and configured such that a cooled air stream generated by the fan is provided into the freezer cavity area and circulated therein. The appliance further comprises at least one air outlet formed between the freezer cavity area and the fresh food cavity area, the air outlet configured to permit at least a portion of the cooled air stream generated by the fan of the evaporator assembly and circulated in the freezer cavity area to flow into the fresh food cavity area through the air outlet. The appliance still further comprises at least one air return formed between the evaporator assembly and the fresh food cavity area, the air return configured such that air from the fresh food cavity area flows into the evaporator assembly through the air return.

Advantageously, a refrigeration system (e.g., a top mount refrigerator appliance) according to embodiments of the invention eliminates the air tower and the airflow restriction associated therewith, thus resulting in lower manufacturing costs and improved energy efficiency.

These and other embodiments of the invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

One or more of the embodiments of the invention will be described below in the context of a refrigerator appliance such as a household refrigerator. However, it is to be understood that embodiments of the invention are not intended to be limited to use in household refrigerators. Rather, embodiments of the invention may be applied to and deployed in any other suitable refrigeration system environment in which it would be desirable to improve energy efficiency and reduce manufacturing costs.

Figure 1:
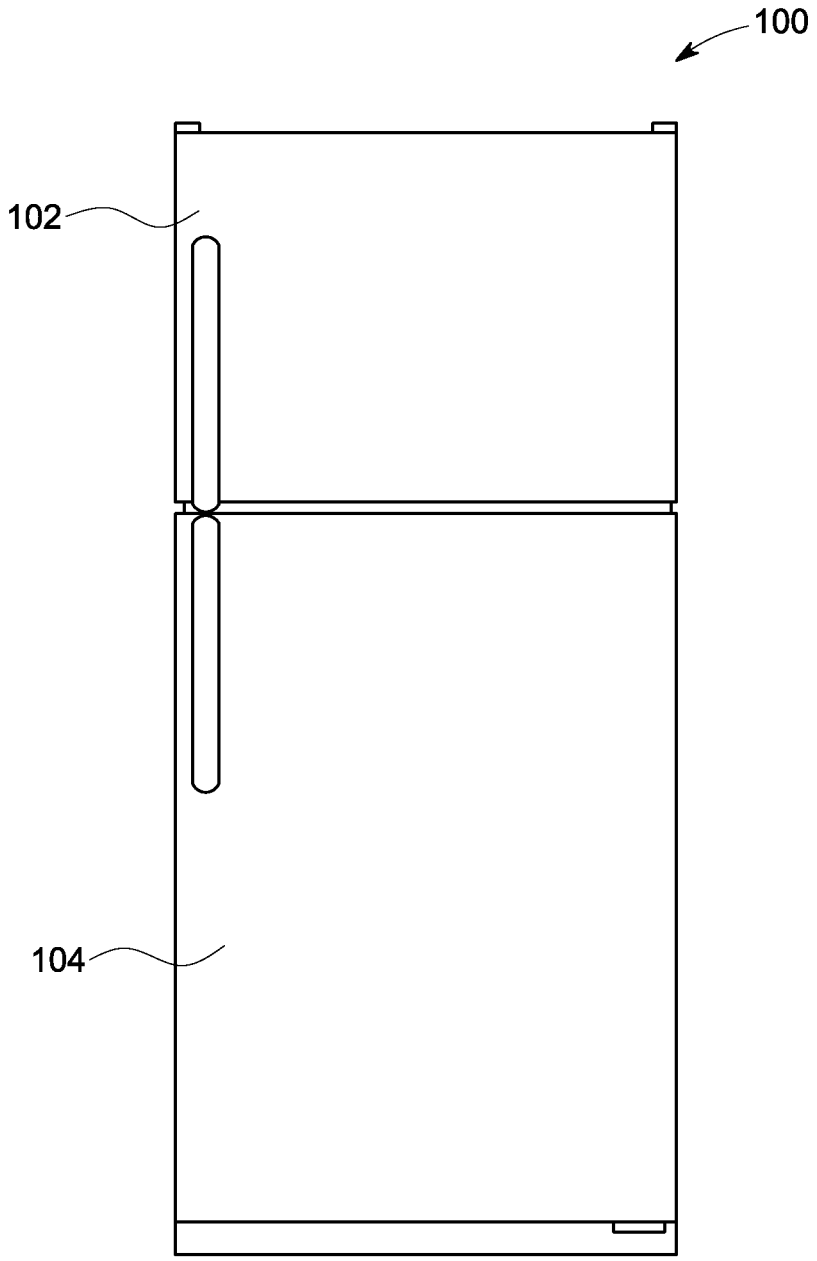
FIG. 1 is a diagram of a front view of a top mount refrigerator, in accordance with one embodiment of the invention.

FIG. 1 illustrates an exemplary refrigeration system in the form of refrigerator appliance 100 within which embodiments of the invention may be implemented. As is typical, a refrigerator has a freezer compartment 102 and a fresh food compartment 104. The fresh food compartment typically maintains foods and products stored therein at temperatures at or below about 40 degrees Fahrenheit in order to preserve the items therein, and the freezer compartment typically maintains foods and products at temperatures below about 32 degrees Fahrenheit in order to freeze the items therein.

More particularly, the refrigerator appliance 100 in FIG. 1 illustrates the freezer compartment 102 and the fresh food compartment 104 in a top mount configuration where the freezer compartment 102 is situated on top of the fresh food compartment 104.

It is to be appreciated that embodiments of the invention may be implemented in the refrigerator appliance 100. However, embodiments of the invention are not intended to be limited to implementation in a refrigerator such as the one depicted in FIG. 1. That is, embodiments of the invention may be implemented in other household refrigerator appliances, as well as non-household (e.g., commercial) refrigerator appliances. Furthermore, embodiments of the invention may be implemented in any appropriate refrigeration system.

As will be illustratively explained herein, embodiments of the invention provide a practical method of reducing cost and energy use associated with a top mount airflow system. This is accomplished by eliminating the air tower, which, as explained above, supplies air to the fresh food compartment and is a large source of restriction, and replacing this tower with effectively placed airflow openings between the freezer and fresh food compartments in the form of one or more air (supply) outlets and one or more air returns. The one or more air outlets formed between the freezer compartment and the fresh food compartment supply a portion of the cooled air circulating in the freezer compartment to the fresh food compartment. The one or more air returns then allow air from the fresh food compartment to return to the evaporator assembly in the freezer compartment.

In one embodiment, the air outlets and air returns are hollow pipes or tubes formed from plastic (e.g., polyvinyl chloride or PVC), wherein each pipe has a substantially constant diameter over its length. In an alternate embodiment, the air returns may each be formed with a Venturi pipe. A Venturi pipe (or tube) is configured with a diametric narrowing over at least part of its length to reduce the pressure and increase the velocity of a gas passing there through. While Venturi pipes may be used in one or more embodiments, it is to be appreciated that air returns without Venturi capability are able to produce the desired fresh food airflow without adding any restriction to the airflow circuit.

In a typical interior airflow system, fresh food airflow is only approximately 10% of the airflow produced by an evaporator fan. For example, such a system may provide 4 or 5 cubic feet per minute (CFM) of fresh food airflow while providing 40 or 50 CFM of freezer airflow. Less fresh food airflow is required because the air circulating through the fresh food compartment undergoes a larger change in temperature and is therefore able to absorb more heat per unit of mass than the air that circulates through the freezer. Because of the relatively low fresh food airflow requirement, traditional airflow systems (i.e., using air towers) are designed with a large amount of restriction to insure that the correct proportion of airflow is provided to the fresh food and freezer compartments.

The high efficiency design provided by illustrative embodiments of the invention allows the freezer airflow path to be optimized for minimum restriction and fan energy use. Fresh food airflow is provided by the one or more air returns formed between the fresh food compartment and the evaporator assembly located in the freezer evaporator compartment which serve to draw air from the fresh food compartment The airflow from the freezer compartment to the fresh food compartment (through the one or more air outlets) and from the fresh food compartment back to the evaporator assembly in the freezer compartment (through the one or more air returns) is due to a pressure differential between the freezer compartment and the fresh food compartment created primarily by the operation of the evaporator fan. An example of improved performance realized in accordance with the inventive design, from the perspective of pressure drop versus flow rate (resistance curve), will be described below in the context of FIG. 4. The airflow path between the evaporator and freezer compartment is configured and the outlet(s) between the freezer compartment and the fresh food compartment and the returns from the freezer and fresh food compartments to the evaporator are sized to provide the desired proportional air flow to the fresh food compartment. Such sizing may be determined empirically for each particular design as is well known in the art.

Advantageously, the design provided by illustrative embodiments of the invention does not split the air stream from the evaporator fan (as in the air tower approach), but rather allows the entire airstream generated by the evaporator fan to circulate through the freezer compartment. A portion of the air circulating through the freezer compartment flows from the freezer compartment into the fresh food compartment to provide cooling therein, as will be explained further below. Because the air flows from the evaporator through the freezer with the desired proportion then flowing through the fresh food compartment, the overall path requires substantially less restriction than is needed in the air tower configuration of the prior art to achieve the necessary balance between freezer air and fresh food air. This allows the evaporator fan to be operated more efficiently.

Figure 2:
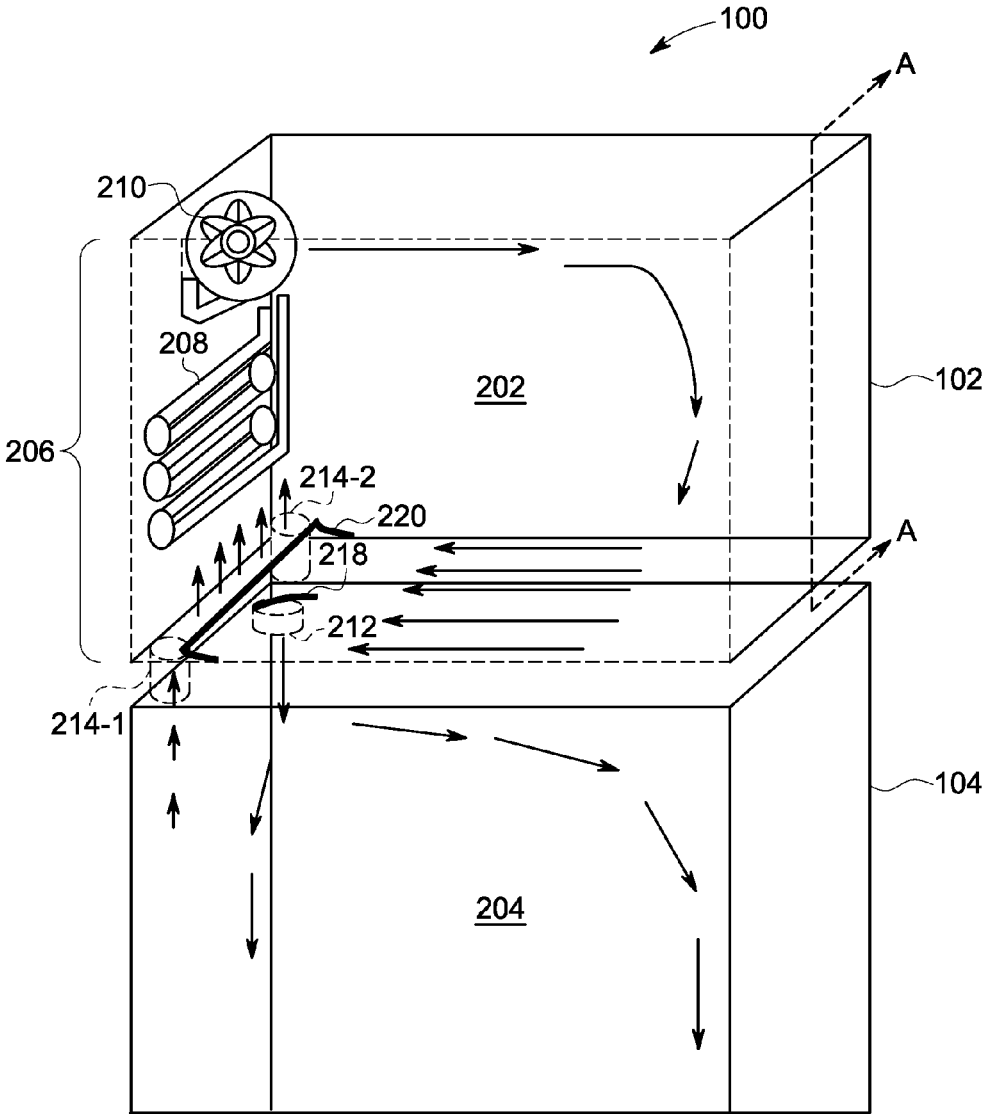
FIG. 2 is a diagram of a perspective side view of an improved airflow system for a top mount refrigerator, in accordance with one embodiment of the invention.
Figure 3:
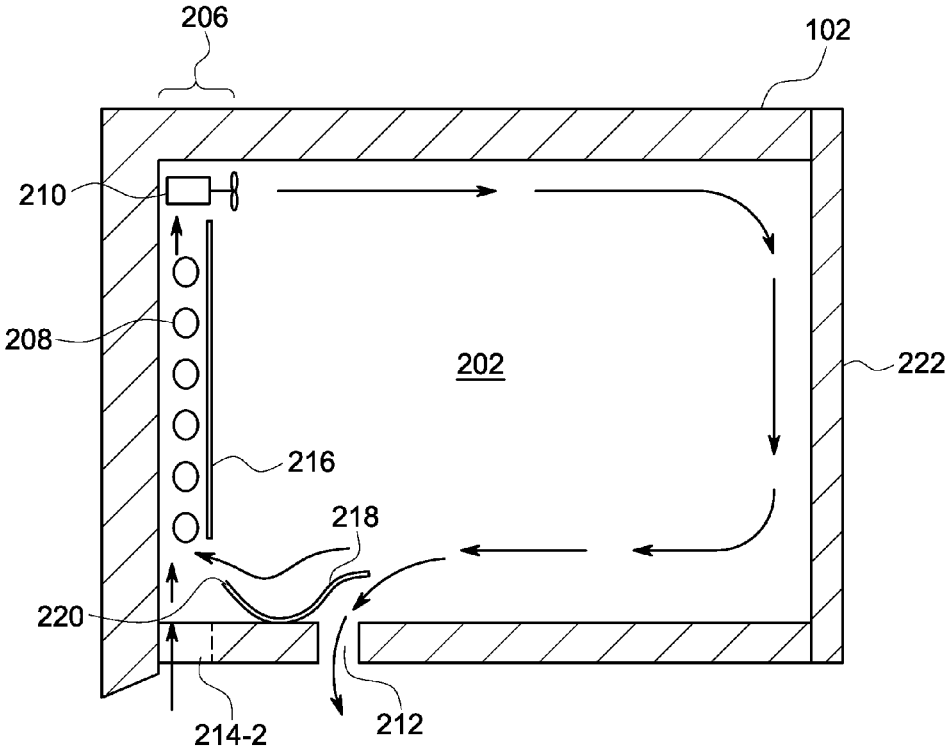
FIG. 3 is a diagram of a side cutaway view of an improved airflow system for a top mount refrigerator, in accordance with one embodiment of the invention.

FIGS. 2 and 3 illustrate an improved airflow system for a top mount refrigerator such as, for example, refrigerator appliance 100 in FIG. 1. FIG. 2 shows a perspective side view of refrigerator appliance 100 with the front of the refrigerator to the right side of the figure and the rear of the refrigerator to the left side of the figure. FIG. 3 shows a side cutaway view of the freezer compartment 102 taken along line 3-3 of FIG. 2.

As shown, refrigerator appliance 100 comprises a freezer compartment 102 and fresh food component 104. The freezer component 102 comprises a freezer cavity area 202, while the fresh food compartment 104 comprises a fresh food cavity area 204. The cavity areas are the open areas in each cooling compartment in which cooled air circulates in order to maintain the desired temperatures in the freezer compartment and the fresh food compartment.

Operatively positioned in the rear of the freezer compartment 102 is an evaporator assembly 206. As shown, the evaporator assembly 206 comprises an evaporator coil (or simply, evaporator) 208 and a fan 210. The evaporator assembly 206 also comprises an evaporator cover 216 which is not expressly shown in FIG. 2 for the sake of clarity, but which is shown in the side cutaway view of FIG. 3.

The freezer compartment 102 also comprises an air outlet 212 formed between the freezer cavity area 202 and the fresh food cavity area 204. As mentioned above, the outlet supplies a portion of the cooled air stream circulating in the freezer cavity area 202 to the fresh food cavity area 204. In one embodiment, the air outlet 212 is a pipe or tube with an internal diameter of about 1.35 inches, which provides a cross sectional area of approximately 1.4 sq. inches. In an alternate embodiment, the air outlet can be a custom molded part of this cross sectional area. Such a custom molded part may include an attachment provision to the liners and a seal to keep foam from leaking out and water from leaking in. Note also that while FIG. 2 illustrates the air outlet as being round in cross sectional shape, the part can have a square cross sectional shape with rounded edges. Alternatively, the part could have a square cross sectional shape without rounded edges. In such an embodiment, the sides are about 1.2 inches.

The freezer compartment 102 also comprises a pair of air returns 214-1 and 214-2 formed between the evaporator assembly 206 and the fresh food cavity area 204. In alternative embodiments, less (e.g., one) or more (e.g., three or more) air returns may be employed in the airflow system. By way of example only, the inner diameter (I.D.) and outer diameter (O.D.) of each air return may be about 1.35 inches and about 1.5 inches, respectively. Also, it is to be appreciated that shapes and/or materials other than those mentioned herein may be used to implement the air returns.

In this embodiment, refrigeration efficiency is improved, particularly in high humidity environments, by positioning the air returns 214-1 and 214-2 proximate to respective sides of the evaporator assembly 206, as shown in FIG. 2. Since much of the humidity that causes frost to form on evaporator coil 208 is carried in the airflow that returns from the fresh food cavity area 204, it is advantageous to position these returns below and at the respective sides of the evaporator coil 208 so frost can form while still allowing airflow over the central portion of the evaporator coil 208. Also, as mentioned above, in an alternate embodiment, each air return 214-1 and 214-2 comprises a Venturi pipe configuration.

The refrigerator appliance 100 also comprises an air deflector 218 mounted proximate to the air outlet 212. Likewise, an air deflector 220 is mounted proximate to the evaporator assembly 206, as shown.

The evaporator assembly 206 is operatively positioned in the freezer compartment 102 and configured such that a cooled air stream generated by fan 210 is provided into the freezer cavity area 202 and circulated therein (see arrows circulating through area 202). Note that airflow to the left of the evaporator cover 216 shown in FIG. 3 is considered low side (or low pressure) airflow, while airflow to the right of the cover 206 is considered high side (or high pressure) airflow. Note also that the freezer compartment door is denoted in FIG. 3 with reference label 222.

The air outlet 212 and the air deflector 218 are configured to permit at least a portion of the cooled air stream generated by fan 210 of the evaporator assembly 206 and circulated in the freezer cavity area 202 to flow into the fresh food cavity area 204 through the air outlet 212. Air from the freezer cavity area 202 flows into the fresh food cavity area 204 through the air outlet 212 due to the pressure differential between the freezer cavity area 202 and the fresh food cavity area 204. It is to be understood that the air deflector 218 is used to further direct airflow through the air outlet 212; however, in one embodiment, the deflector 218 can be removed such that air is drawn into the air outlet 212 without the aid of the deflector 218.

The air returns 214-1 and 214-2 are configured such that air circulating in the fresh food cavity area 204 flows into the evaporator assembly 206 through the air returns 214-1 and 214-2. Note also that air deflector 220 allows airflow from the freezer cavity area 202 to return to the evaporator assembly 206 past the bottom of the evaporator cover 216. The air returning from the freezer cavity area 202 and the fresh food cavity area 204 mixes and is drawn by the fan 210 across the evaporator coil 208 through which the refrigerant passes to absorb and remove the heat from the warmer returning air. The cooled air is then pushed out into the freezer cavity area 202 by the fan 210, and the cycle repeats.

Figure 4:
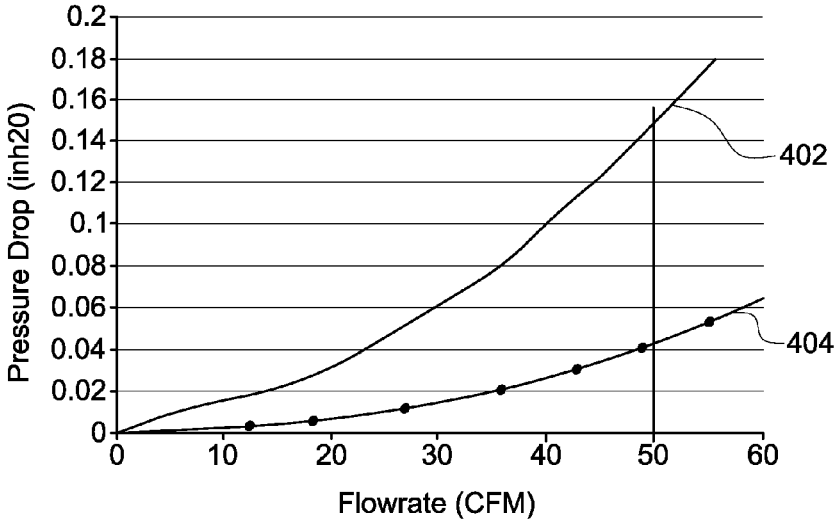
FIG. 4 is a diagram illustrating performance improvement associated with an airflow system in accordance with one embodiment of the invention.

FIG. 4 is a diagram illustrating performance improvement associated with an airflow system in accordance with one embodiment of the invention. In particular, the graph of FIG. 4 illustrates pressure drop versus flow rate (resistance curve) for the embodiment illustrated in FIGS. 2 and 3.

In FIG. 4, the upper curve 402 (baseline) is a typical resistance curve for a top mount (TM) refrigerator with the air tower configuration of the prior art. The lower curve 404 is the improved system curve associated with the air flow path of the illustrative embodiment of FIGS. 2 and 3. This curve clearly illustrates the reduced load on the evaporator fan in the embodiment of FIGS. 2 and 3 versus the air tower configuration. By way of example, at 50 CFM, the evaporator fan for the air tower configuration needs to provide about 0.15 inches of pressure. Whereas, an evaporator fan in the inventive airflow system only needs to provide about 0.04 inches of pressure to achieve the 50 CFM flow rate and, thus, is significantly more energy efficient in terms of energy needed to operate the evaporator fan.

Among other advantages, as are evident from the inventive teachings provided herein, the airflow system design according to embodiments of the invention reduces cost by eliminating a large plastic component (i.e., the air tower) that currently fills freezer volume, and adds to manufacturing costs. By way of example only, the design can increase internal freezer volume by about 100 cubic inches or about 0.06 cubic feet.

The inventive airflow system design also improves the fresh food temperature gradient by providing greater separation between the supply and return than is typical of conventional designs.

Still further, as described herein, the inventive airflow system design uses freezer compartment air to cool the fresh food compartment. Because the air exiting the freezer into the fresh food compartment is at a warmer temperature than air exiting directly from the evaporator, approximately 10% more fresh food supply air is required relative to an air tower configuration. This increase in fresh food supply air increases the average temperature of the air entering the evaporator by approximately 0.4 degrees Fahrenheit. This warmer air causes a warmer evaporation temperature resulting in an improved cooling cycle which is estimated to save approximately 0.5% in energy.

The simplified airflow path of the inventive design also allows for a reduction in the size of the evaporator fan. By way of example only, it has been realized that a three watt evaporator fan can be replaced by a fan that draws less than two watts while still providing similar airflow. A reduction of one watt from an evaporator fan can save about 2 to 3% in energy use on a product of this type.

It is to be appreciated that temperature control for the embodiments herein described may be implemented in conventional manner well known to those ordinarily skilled in the art. For example, the cooling system may be configured to respond to the temperature in the fresh food compartment. More particularly, a temperature sensor monitors the temperature in the fresh food compartment. When the temperature exceeds the reference turn-on temperature associated with the user selected set point temperature for the compartment, the compressor turns on. When the temperature drops below the reference turn-off temperature associated with the set point temperature, the compressor turns off.

It is to be further appreciated that one ordinarily skilled in the art will realize that well-known heat exchange and heat transfer principles may be applied to determine appropriate dimensions and materials of the various assemblies illustratively described herein, as well as flow rates of refrigerant that may be appropriate for various applications and operating conditions, given the inventive teachings provided herein.

It is to be further appreciated that the refrigeration systems described herein may have control circuitry including, but not limited to, a microprocessor (processor) that is programmed, for example, with suitable software or firmware, to implement one or more techniques as described herein. In other embodiments, an ASIC (Application Specific Integrated Circuit) or other arrangement could be employed. One of ordinary skill in the art will be familiar with refrigeration systems and given the teachings herein will be enabled to make and use one or more embodiments of the invention; for example, by programming a microprocessor with suitable software or firmware to cause the refrigeration system to perform illustrative steps described herein. Software includes but is not limited to firmware, resident software, microcode, etc. It is to be further understood that part or all of one or more features of the invention discussed herein may be distributed as an article of manufacture that itself comprises a tangible computer readable recordable storage medium having computer readable code means embodied thereon. The computer readable program code means is operable, in conjunction with a computer system or microprocessor, to carry out all or some of the steps to perform the methods or create the apparatuses discussed herein. A computer-usable medium may, in general, be a recordable medium (e.g., floppy disks, hard drives, compact disks, EEPROMs, or memory cards) or may be a transmission medium (e.g., a network comprising fiber-optics, the world-wide web, cables, or a wireless channel using time-division multiple access, code-division multiple access, or other radio-frequency channel). Any medium known or developed that can store information suitable for use with a computer system may be used. The computer-readable code means is any mechanism for allowing a computer or processor to read instructions and data, such as magnetic variations on magnetic media or height variations on the surface of a compact disk. The medium can be distributed on multiple physical devices. As used herein, a tangible computer-readable recordable storage medium is intended to encompass a recordable medium, examples of which are set forth above, but is not intended to encompass a transmission medium or disembodied signal. A microprocessor may include and/or be coupled to a suitable memory.

Furthermore, it is also to be appreciated that embodiments of the invention may be implemented in electronic systems under control of one or more microprocessors and computer readable program code, as described above, or in electromechanical systems where operations and functions are under substantial control of mechanical control systems rather than electronic control systems.

Thus, while there have been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A refrigeration system comprising:

a first cooling compartment having a first cooling cavity area;

a second cooling compartment having a second cooling cavity area, wherein the first cooling compartment is positioned above the second cooling compartment, and the first cooling cavity area is maintained at a lower temperature than the second cooling cavity area;

an evaporator assembly comprising an evaporator and a fan, the evaporator assembly operatively positioned in the first cooling compartment and configured such that a cooled air stream generated by the fan is provided into the first cooling cavity area and circulated therein;

at least one air outlet formed between the first cooling cavity area and the second cooling cavity area, the air outlet configured to permit at least a portion of the cooled air stream generated by the fan of the evaporator assembly and circulated in the first cooling cavity area to flow directly from the first cooling cavity area into the second cooling cavity area through the air outlet; and at least one air return formed between the evaporator assembly and the second cooling cavity area, the air return configured such that air from the second cooling cavity area flows into the evaporator assembly through the air return, wherein the first cooling compartment is a freezer compartment, the first cooling cavity area is a freezing cavity area, the second cooling compartment is a fresh food compartment, the second cooling cavity area is a fresh food cavity area, and the evaporator assembly is positioned in the freezing cavity area of the freezer compartment.

2. The refrigeration system of claim 1, wherein the portion of the cooled air stream generated by the fan of the evaporator assembly and circulated in the first cooling cavity area flows into the second cooling cavity area through the air outlet due to a pressure differential between the first cooling cavity area and the second cooling cavity area.

3. The refrigeration system of claim 1, wherein the air return comprises a Venturi pipe.

4. The refrigeration system of claim 1, further comprising at least another air return formed between the evaporator assembly and the second cooling cavity area, the other air return also configured such that air from the second cooling cavity area flows into the evaporator assembly.

5. The refrigeration system of claim 4, wherein the one air return is positioned below one side of the evaporator of the evaporator assembly and the other air return is positioned below another side of the evaporator of the evaporator assembly.

6. The refrigeration system of claim 1, wherein the evaporator assembly further comprises an evaporator cover configured to permit at least a portion of the air stream generated by the fan and circulated in the first cooling cavity area to re-enter the evaporator assembly.

7. The refrigeration system of claim 1, further comprising an air deflector mounted entirely within the first cooling compartment proximate to the air outlet and configured to deflect at least a portion of the air stream generated by the fan and circulated in the first cooling cavity area towards the air outlet.

8. A top mount refrigerator appliance comprising:

a freezer compartment having a freezer cavity area;

a fresh food compartment having a fresh food cavity area;

an evaporator assembly comprising an evaporator and a fan, the evaporator assembly operatively positioned in the freezing cavity area of the freezer compartment and configured such that a cooled air stream generated by the fan is provided into the freezer cavity area and circulated therein;

at least one air outlet formed between the freezer cavity area and the fresh food cavity area, the air outlet configured to permit at least a portion of the cooled air stream generated by the fan of the evaporator assembly and circulated in the freezer cavity area to flow directly from the freezer cavity area into the fresh food cavity area through the air outlet; and at least one air return formed between the evaporator assembly and the fresh food cavity area, the air return configured such that air from the fresh food cavity area flows into the evaporator assembly through the air return.

9. The top mount refrigerator appliance of claim 8, wherein the portion of the cooled air stream generated by the fan of the evaporator assembly and circulated in the freezer cavity area flows into the fresh food cavity area through the air outlet due to a pressure differential between the freezer cavity area and the fresh food cavity area.

10. The top mount refrigerator appliance of claim 8, wherein the air return comprises a Venturi pipe.

11. The top mount refrigerator appliance of claim 8, further comprising at least another air return formed between the evaporator assembly and the fresh food cavity area, the other air return also configured such that air from the fresh food cavity area flows into the evaporator assembly.

12. The top mount refrigerator appliance of claim 11, wherein the one air return is positioned below one side of the evaporator of the evaporator assembly and the other air return is positioned below another side of the evaporator of the evaporator assembly.

13. The top mount refrigerator appliance of claim 8, wherein the evaporator assembly further comprises an evaporator cover configured to permit at least a portion of the air stream generated by the fan and circulated in the freezer cavity area to re-enter the evaporator assembly.

14. The top mount refrigerator appliance of claim 8, further comprising an air deflector mounted entirely within the freezer compartment proximate to the air outlet and configured to deflect at least a portion of the air stream generated by the fan and circulated in the freezer cavity area towards the air outlet.

* * * * *